US008578540B2

(12) United States Patent
Byrne

(10) Patent No.: US 8,578,540 B2
(45) Date of Patent: Nov. 12, 2013

(54) VIBRATING MOP HEAD

(75) Inventor: Adam Benjamin Byrne, Los Angeles, CA (US)

(73) Assignee: Bona AB, Malmo (SE)

( * ) Notice: Subject to any disclaimer, the term of this patent is extended or adjusted under 35 U.S.C. 154(b) by 421 days.

(21) Appl. No.: 13/007,616

(22) Filed: Jan. 15, 2011

(65) Prior Publication Data

US 2012/0180239 A1 Jul. 19, 2012

(51) Int. Cl.
*A47L 11/00* (2006.01)

(52) U.S. Cl.
USPC ..... 15/49.1; 15/98

(58) Field of Classification Search
USPC ..... 15/97.1, 98, 49.1, 50.1, 154.2
See application file for complete search history.

(56) References Cited

U.S. PATENT DOCUMENTS

| | | | | |
|---|---|---|---|---|
| 3,251,087 | A | 5/1966 | Platt, Jr. | |
| 3,357,033 | A | 12/1967 | Sawyer | |
| 3,395,416 | A | 8/1968 | Hughes | |
| 3,528,120 | A | 9/1970 | Lindstrom | |
| 3,608,108 | A | 9/1971 | Sawyer | |
| 3,657,759 | A | 4/1972 | Sawyer | |
| 3,737,938 | A | 6/1973 | Saltzstein | |
| 3,778,860 | A | 12/1973 | Thielen | |
| 3,991,432 | A | 11/1976 | Griffin et al. | |
| 3,996,639 | A | 12/1976 | Griffin et al. | |
| 4,295,240 | A | 10/1981 | Lex | |
| 4,685,167 | A | 8/1987 | Murray | |
| 4,829,719 | A | 5/1989 | Braselton | |
| 4,852,210 | A | 8/1989 | Krajicek | |
| 4,866,804 | A * | 9/1989 | Masbruch et al. | 15/49.1 |
| 5,381,578 | A | 1/1995 | Armbruster | |
| 5,419,015 | A | 5/1995 | Garcia | |
| 5,471,695 | A | 12/1995 | Aiyar | |
| 5,960,508 | A | 10/1999 | Holt et al. | |
| 6,003,191 | A | 12/1999 | Sherry et al. | |
| 6,045,622 | A | 4/2000 | Holt et al. | |
| 6,048,123 | A | 4/2000 | Holt et al. | |
| 6,101,661 | A | 8/2000 | Policicchio et al. | |
| 6,601,261 | B1 | 8/2003 | Holt et al. | |
| 6,766,552 | B1 | 7/2004 | Policicchio et al. | |
| 6,854,911 | B2 | 2/2005 | Policicchio et al. | |
| 6,948,873 | B2 | 9/2005 | Policicchio et al. | |
| 6,979,371 | B1 | 12/2005 | Policicchio et al. | |
| 6,996,871 | B1 | 2/2006 | Policicchio et al. | |
| 7,163,349 | B2 | 1/2007 | Policicchio et al. | |
| 7,191,486 | B1 | 3/2007 | Michelson et al. | |
| 7,210,185 | B2 | 5/2007 | Paas | |
| 7,222,391 | B2 * | 5/2007 | Fan | 15/344 |
| 7,313,838 | B2 | 1/2008 | Long et al. | |
| 7,517,411 | B2 | 4/2009 | Hornsby et al. | |
| 7,530,139 | B2 | 5/2009 | Niemeyer et al. | |

(Continued)

*Primary Examiner* — Laura C Guidotti
(74) *Attorney, Agent, or Firm* — Klaas, Law, O'Meara & Malkin, PC; William P. O'Meara

(57) ABSTRACT

A mop head assembly having: a base plate member with a generally flat bottom portion adapted to receive a flexible cleaning member; and an electric motor mounted on the base plate member at a laterally centered position thereon and having a rotatable shaft with an asymmetric weight mounted thereon, the shaft projecting downwardly from the electric motor and oriented substantially perpendicular to the base plate bottom portion, wherein rotation of the asymmetric weight on the shaft causes the base plate to vibrate primarily in a plane parallel to the flat bottom portion. A cover member that covers the electric motor and which is positioned over other components mounted on the base plate is also described.

9 Claims, 4 Drawing Sheets

(56) References Cited

U.S. PATENT DOCUMENTS

| | | | | |
|---|---|---|---|---|
| 7,565,712 | B2 | 7/2009 | Long et al. | |
| 7,650,665 | B2 | 1/2010 | Morris et al. | |
| 7,721,384 | B2 | 5/2010 | Crevling, Jr. et al. | |
| 7,774,894 | B2 | 8/2010 | Rippl et al. | |
| 7,811,022 | B2 | 10/2010 | Bobrosky et al. | |
| 2003/0167585 | A1* | 9/2003 | Chen | 15/97.1 |
| 2007/0022553 | A1 | 2/2007 | Niemeyer et al. | |
| 2007/0240268 | A1 | 10/2007 | Le et al. | |
| 2010/0319147 | A1 | 12/2010 | Geurkink | |

* cited by examiner

VIBRATING MOP HEAD

BACKGROUND

Floor mops have long been used to clean hard surface floors such as wood or tile floors. Mops typically include an elongate handle mounted on a mop head. The handle is often mounted to enable pivotal displacement of the handle relative to the mop head. The mop head usually has a cleaning member removeably attached to it. For example, microfiber cloths are sometimes used as cleaning members. One common method for attaching a cleaning member to a mop head employs hook and loupe type fasteners strips mounted on the bottom of the mop head. Some mops are provided with fluid reservoirs mounted on the mop handles. In such units a sprayer, which may be actuated with a trigger provided on the mop handle, is incorporated into the fluid reservoir. Thus, a person using the mop may spray cleaning solution on the floor in front of the mop as the mop is pushed across the floor.

DETAILED DESCRIPTION

Figure 1:
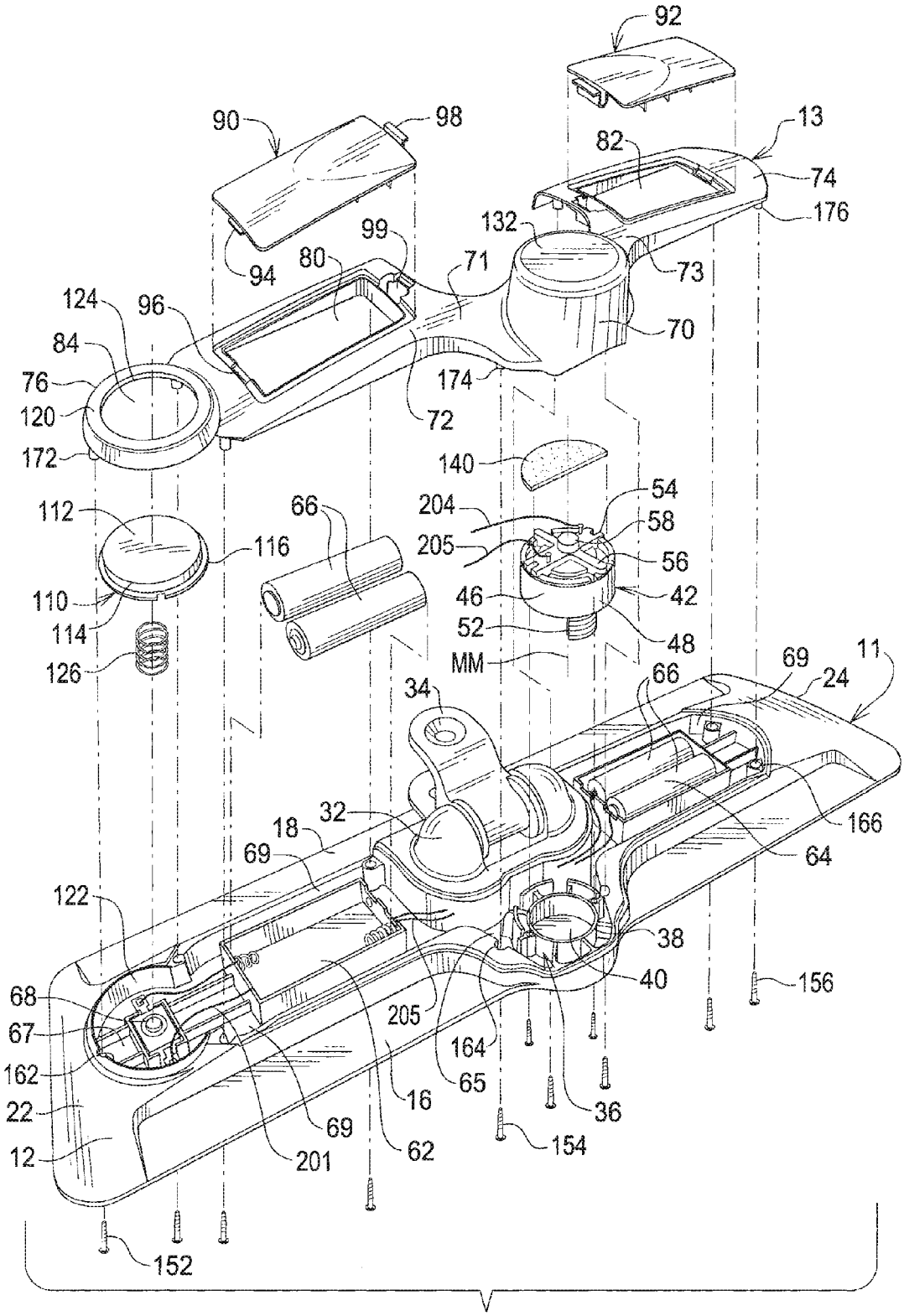
FIG. 1 is an exploded isometric view of a vibrating mop head.
Figure 2:
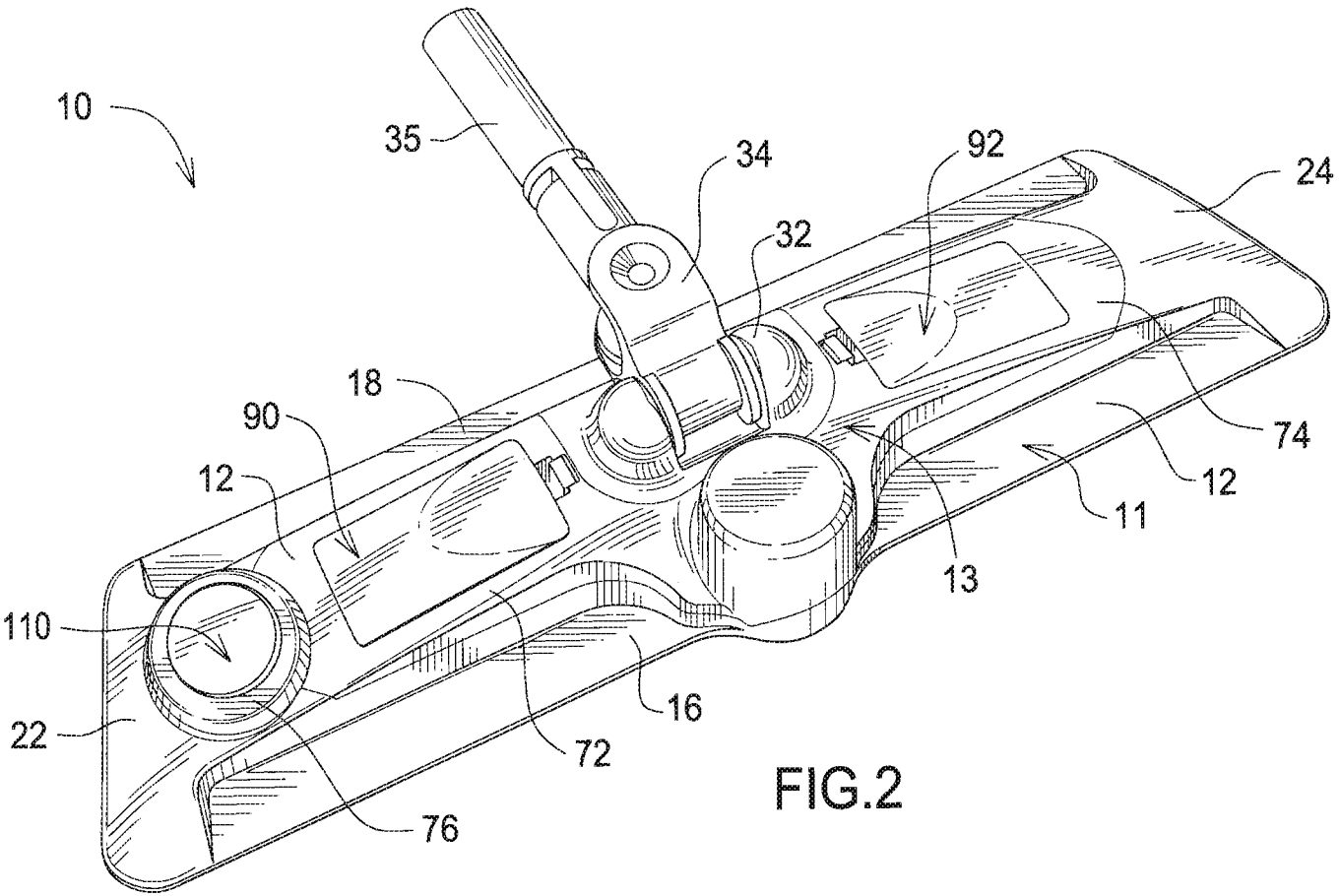
FIG. 2 is a top isometric view of a vibrating mop head.
Figure 3:
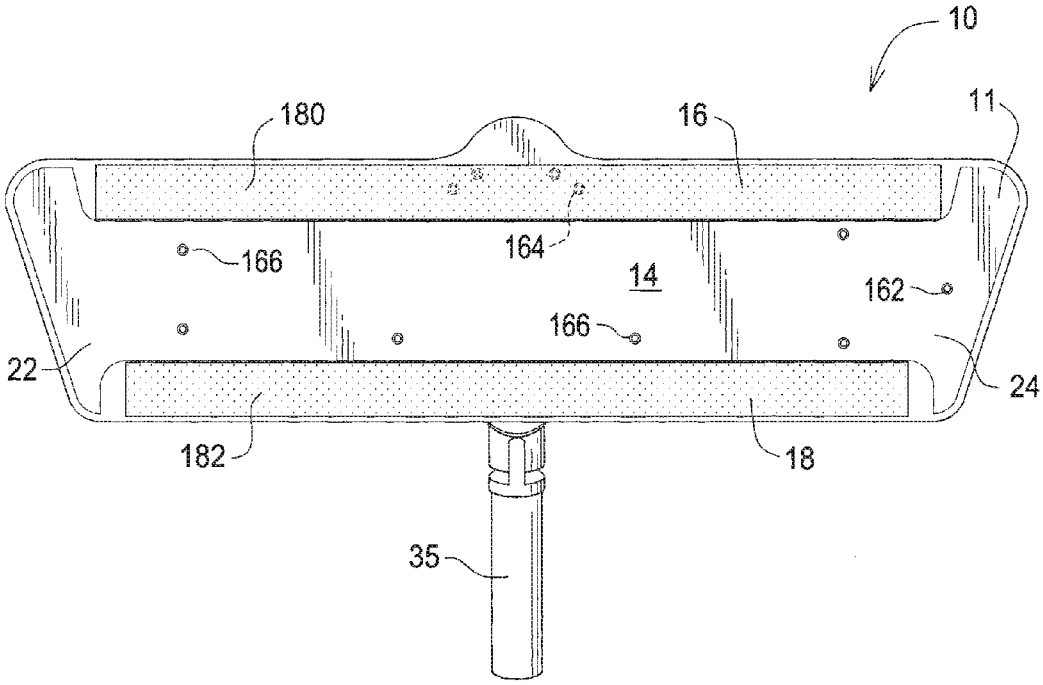
FIG. 3 is a bottom plan view of a vibrating mop head.

FIGS. 1-3 illustrate a mop head 10 that has a base plate member 11 and a cover member 13 mounted on the base plate member. The base plate member 11 has a top face 12, a bottom face 14, a front end portion 16 and a back end portion 18. The base plate member 11 has a first lateral side portion 22 and a second lateral side portion 24.

A handle attachment portion 32 such as a knuckle may be integrally formed at a laterally and longitudinally centered position on the base plate member 11. A handle receiving adapter member 34 may be pivotally connected to the handle attachment portion 32 about a laterally extending pivot axis, and a mop handle 35 may be mounted in the adapter member 34. In one embodiment the adapter member contains a pivot joint so that the handle is pivotable about two axes relative to the mop head 10. Mop handle connection assemblies such as above described are known in the art.

Figure 4:
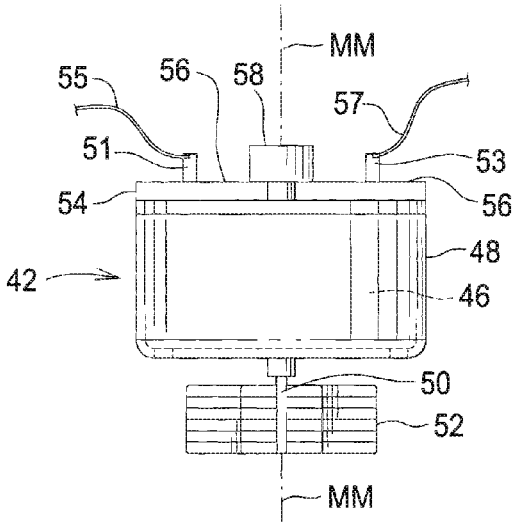
FIG. 4 is a side elevation view of a vibration unit.
Figure 5:
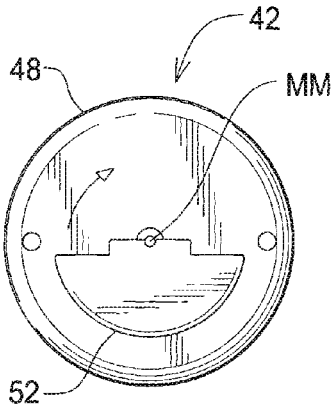
FIG. 5 is a bottom plan view of a vibration unit.

A motor bay 36 is provided on the top face 12 of the base plate member 11 at a location in longitudinal alignment with and forward of the handle attachment portion 32. A tubular member 38 with a cylindrical cavity 40 is mounted in the motor bay 36. A vibration unit 42 is supported by the tubular member 38. The vibration unit 42, as best shown in FIGS. 1, 4 and 5 includes a motor 46 having a cylindrical motor housing 48. A motor shaft 50 extends downwardly from the housing 48 and is rotatable about an axis MM. An asymmetric weight 52 is mounted on the shaft 50 and rotates with it about rotation axis MM. First and second electric terminals 51, 53 may extend from a top portion of the motor housing 48 and are connected to leads 205, 204. Electricity to drive the motor 46 is provided through the terminals 51, 53. Vibration units using asymmetric weights are known in the art. A motor mounting and centering member 54 may be mounted on top of the motor housing 48. The member 54 may be generally disc shaped and may include a plurality of radially projecting ribs 56 and a central stud 58. The motor housing 48 is supported at the top of the tubular member 38 with the motor shaft 50 and asymmetric weight 52 positioned within the cylindrical cavity 40. The radius of the cavity 40 is selected to be slightly larger than the radius of the asymmetric weight 52 to allow the weight 52 to rotate without contacting the sidewall of the tubular member 38.

As best shown by FIG. 1, a first battery bay 62 and a second battery bay 64 are symmetrically positioned with respect to handle attachment portion 32. The battery bays 62, 64 may be adapted to each receive two batteries 66, which may be AA sized batteries. The batteries may be connected in series and provide operating power to the motor 46 as further discussed below.

A switch bay 67, FIG. 1, may be formed on the top face 12 of the base plate member 11 at a lateral end portion 22 of the base plate member 11. An on-off plunger switch 68 may be positioned at a centered location in the switch bay 67. Plunger switches are well known in the art and are readily commercially available from multiple sources.

In one embodiment of the invention, the motor bay 36, the battery bays 62, 64 and the switch bay 67 are all formed in an elongate recess 69 in the top face 12 of the base plate member 11. This recess 69 forms a laterally and longitudinally extending, dry "moat" around the handle attachment portion 32. This moat contains and protects conductor wires or leads 201, 205, etc., that electrically connect the batteries 66 in the battery bays 62, 64 to the motor 46 and plunger switch 68.

Figure 6:
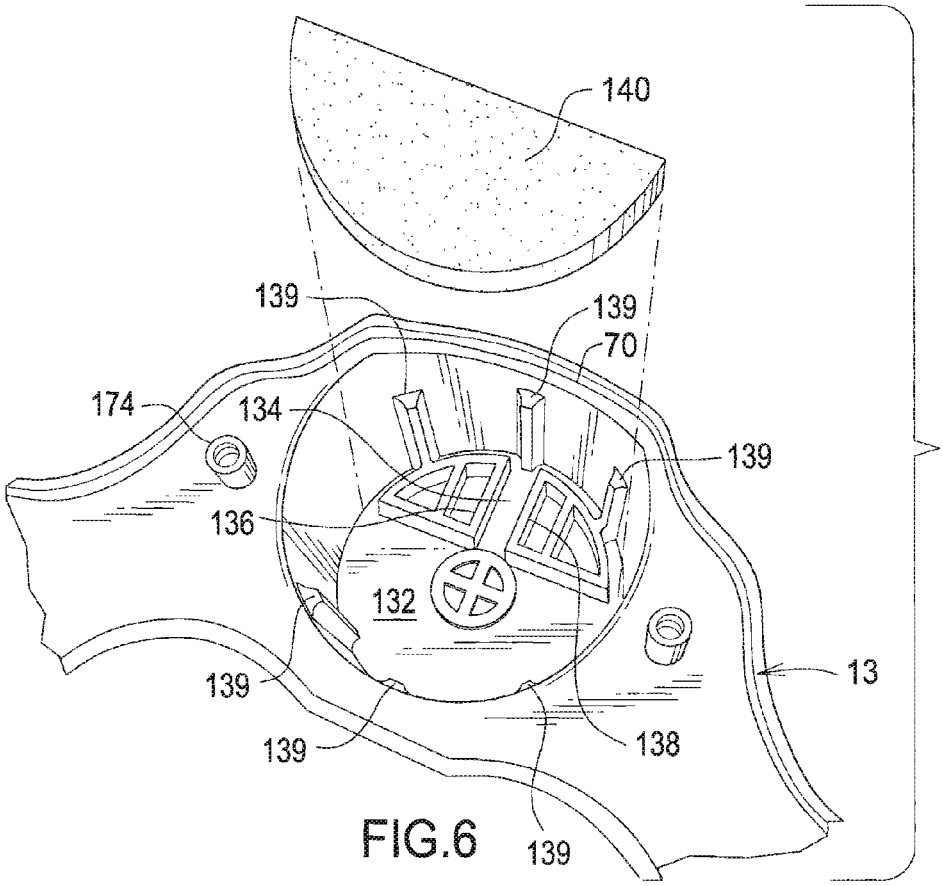
FIG. 6 is a bottom, exploded, detail isometric view of a vibrating mop cover member.

As best shown in FIGS. 1, 2 and 6, cover member 13 is adapted to be mounted over the moat forming recess 69. The cover member 13 has a centrally and forwardly positioned motor shroud portion 70 which has an inverted cup shape. The cover member 13 includes laterally extending wing portions 72, 74 which may be integrally formed with and connected to the motor shroud portion 70 by shoulder portions 71, 73. An outer ring portion 76 may be integrally connected to a lateral end of wing portion 72. Battery bay openings 80, 82 provide access to battery bays 62, 64 respectively. A switch bay circular opening 84 may be provided in outer ring portion 76 of the cover member 13.

Battery cover plates 90, 92 may be provided to selectively cover and uncover the battery bays 62, 64, respectively. Each battery cover plate may be generally the same shape as the associated battery bay opening 80, 82 and each plate may comprise a tab portion 94 at one end and a U-shaped detent member 98 at the other end. Tab receiving recesses 96 and detent slots 99 may be formed in the cover member 13 to allow the plates 90, 92 to be easily attached and detached from the cover member 13 to cover or uncover the battery bays 62, 64 and batteries 66 mounted therein.

A cap member 110 may have a slightly domed top portion 112, an annular side wall portion 114 and an annular, outwardly projecting bottom rim portion 116. The cap member 110 is adapted to be slidingly received in the switch bay circular opening 84. The cap member is prevented from moving out of the opening 84 by engagement of the cap member bottom rim portion 116 with an inwardly extending upper rim portion 120 of outer ring portion 76 of cover member 13. A biasing member, such as a coil spring 126, may be positioned between the cap member 110 and the plunger switch 68. The spring 126 biases the cap member 110 upwardly to a position where the cap bottom rim portion 116 engages upper rim portion 120. A person may actuate the plunger switch 68 by pushing downwardly on the cap member 110 until the cap member engages the plunger switch 68 and urges it down sufficiently far to change the switch operating state, i.e. to change it from an open circuit to a closed circuit operating state or vice versa. The plunger switch 68 is itself upwardly biased so that it will return to an "up" position after force applied to it by pushing on the cap member is released. The cap member 110 is prevented from being displaced laterally by an annular sidewall 122 of the switch bay 67 and by the annular sidewall portion 124 of the outer ring portion 76.

The manner in which the vibration unit 42 is supported will now be further described. FIG. 6 is a detail bottom view of the cover member 13. The motor shroud portion 70 has a closed top portion 132 (which looks like the bottom of an inverted cup). A radially extending groove 134 is defined by lattice rib structures 136, 138, A rib 56 of the motor top end mounting member 54 is received in this groove 134 and the motor 46 is thereby restrained against rotational movement with respect to the cover member 13. Vertically projecting ribs 139 within the motor shroud portion 70 fit closely against the motor 46 and restrains the motor against radial displacement within the shroud portion 70. A vibration damping member 140, which may be a half-moon shaped foam member, which may be about 1 cm thick, is positioned between the motor top end mounting member 54 and the closed top portion 132 of the shroud portion 70. This vibration damping member prevents the top of the motor 46 from vibrating against the shroud portion 70 and also urges the motor down against tubular member 38, FIG. 1, restraining vertical displacement of the motor 46. The semicircular asymmetric weight 52 rotates within the cavity 40 of tubular member 38 with the asymmetric distribution of weight causing vibration substantially in a direction perpendicular to the axis of rotation MM, i.e., in a direction parallel to the bottom face 14 of the base plate 11.

The cover member 13 may be attached to the base plate member 11 by any number of attachment methods, such as a snap fit tongue and groove structure, adhesives, rivets, etc. In the illustrated embodiment, the cover member 13 and the base plate member 11 are attached by a plurality of screws 152, 154, 156, etc. which are placed in recessed bores 162, 164, 166, etc., that extend through the base plate member. The screws threadingly engage projections 172, 174, 176, etc., in the cover member 13 to securely fasten the cover member to the base plate member 11. Rubber plugs (not shown) or the like may be placed in the recessed bores 162, 164, 166, etc., after the screws have been tightened, to prevent entry of moisture through the bottom face 14 of the base plate. In addition to the screws, adhesive and sealant material may be applied to surfaces where the cover member 13 engages the base plate member 11.

As shown by FIG. 3, the bottom face 14 of the base plate member 11 may have strips 180, 182 of hook and loupe type fastener material mounted thereon as by adhesive or other attachment means. The strips 180, 182 may be used to mount cleaning pads (not shown) on the base plate member 11. Other cleaning pad attachment means such as clamps, ties, etc. may also be used.

Figure 7:
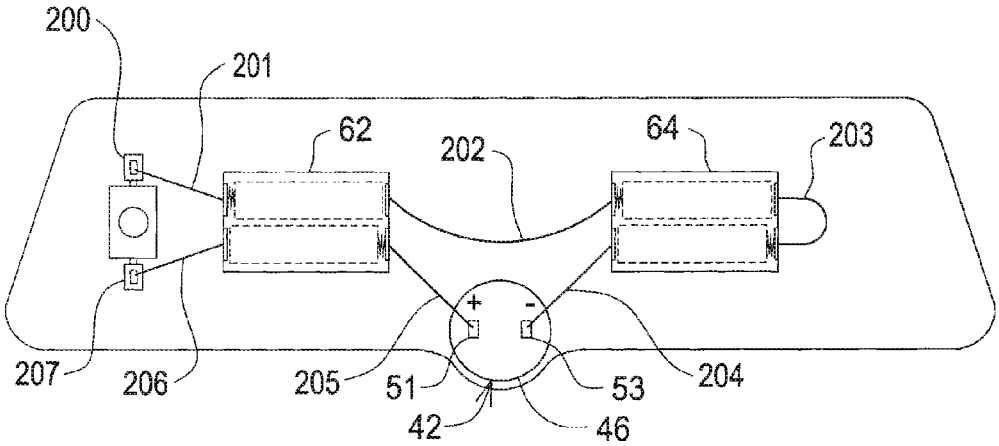
FIG. 7 is a schematic circuit diagram.

FIG. 7 is a schematic circuit drawing showing the electrical connection of the batteries 66 within the battery bays 62, 64 to the motor 46 and plunger switch 68. It will be appreciated from the drawing that the batteries are connected in series. A first terminal of a first battery is electrically connected by conductor wire 201 to switch terminal 200. The second terminal of the first battery is electrically connected to the first terminal of a second battery by wire 202. The second terminal of the second battery is electrically connected to the first terminal of a third battery by wire 203. The second terminal of the third battery is electrically connected to a first terminal 53 of the motor 46 by wire 204. A second terminal 51 of the motor is electrically connected to a first terminal of a fourth battery by wire 205. A second terminal of the fourth battery is electrically connected to the second terminal 207 of the switch by wire 206. Thus, actuating switch 68 to a closed state ("on") causes electricity to flow from the batteries 66 through the motor 46 causing it to rotate weight 52. Moving the switch 68 to an open state ("off") stops flow of electricity to the motor and stops the rotation of weight 52.

In operation, an operator initially attaches a cleaning member, such as a dust cloth (not shown) to the bottom of the base plate member 11, such as by hook and loupe fastener strips 180, 182, FIG. 3. The operator then grasps the handle 35 and moves the mop head 10 to a desired cleaning location. Next the operator pushes against the cap with his or her foot or hand to change the operating state of the switch to turn on the motor. The operator then moves the mop head across the floor as the mop head vibrates. The vibration of the mop head enhances the operation of the mop in picking up dust or otherwise cleaning the floor. In some embodiments, the mop handle 35 has a reservoir (not shown) mounted thereon. The reservoir may include a pump or aerosol device that may be actuated as by a trigger mounted on the handle to spray cleaning solution on the floor in front of the mop.

What is claimed is:

1. A mop head assembly comprising:

a base plate member having a top face, a bottom face, a front end portion, a back end portion, a first lateral end portion, a second lateral end portion, a maximum lateral dimension of said base plate member being substantially greater than a maximum longitudinal dimension of said base plate member;

said base plate member top face comprising:

a mop handle attachment portion located at a laterally and longitudinally centered point on said top face a motor bay located adjacent to said mop handle attachment portion;

first and second symmetrically positioned battery bays;

a switch bay positioned laterally outwardly of one of said battery bays;

wherein said first battery bay is located between said mop handle attachment portion and said first lateral end portion of said base plate member and wherein said second battery bay is located between said mop handle attachment portion and said second lateral end portion of said base plate member;

wherein said motor bay is positioned forward of said mop handle attachment portion;

wherein said motor bay receives an electric motor with a rotatable shaft and an asymmetric weight mounted on said rotatable shaft; and wherein said rotatable shaft extends generally perpendicular to said bottom face.

2. The mop head assembly of claim 1 wherein said rotatable shaft is positioned at a laterally centered location of said base plate member.

3. The mop head assembly of claim 1 wherein said asymmetric weight is positioned below said motor.

4. The mop head assembly of claim 3 wherein said motor bay comprises a tubular member which supports said motor and encloses said asymmetric weight.

5. A mop head assembly comprising:

a base plate member having a top face, a bottom face, a front end portion, a back end portion, a first lateral end portion, a second lateral end portion, a maximum lateral dimension of said base plate member being substantially greater than a maximum longitudinal dimension of said base plate member;

said base plate member top face comprising:

a mop handle attachment portion located at a laterally and longitudinally centered point on said top face;

a motor bay located adjacent to said mop handle attachment portion;

first and second symmetrically positioned battery bays;

a switch bay positioned laterally outwardly of one of said battery bays;

a cover member having a top face and a bottom face; said bottom face of said cover member engaging said top face of said base plate member, said cover member having a switch bay opening positioned over said switch bay;

a plunger switch mounted in said switch bay;

a cap member with a closed top portion, annular sidewall portion and a bottom rim portion, said cap member being captured between surfaces of said switch bay and said cover member; and a biasing member disposed between said switch member and said cap member and biasing said cap member upwardly;

said plunger switch, said cap member and said biasing member being constructed and arranged whereby said cap member moves downwardly in response to pressure to actuate said plunger switch.

6. A vibration unit for a mop head having a base plate member with a flat bottom face and an upper face and a cover member that is attached to said upper face of said base plate member, comprising:

an electric motor having a top portion and a bottom portion and a rotatable shaft projecting downwardly from said bottom portion of said electric motor;

an asymmetric weight mounted on said rotatable shaft;

a tubular housing having upper and lower end portions and a cylindrical cavity, said tubular member being mounted with said lower end portion thereof supported by said base plate member;

said electric motor being mounted with said bottom portion thereof supported by said upper end portion of said tubular housing;

said rotatable shaft and said asymmetric weight being received within said cylindrical cavity;

wherein said cover member is positioned above said top surface of said electric motor and further comprising a compressible member positioned between said top portion of said electric motor and said cover member; and wherein the compressible member comprises a vibration dampening member.

7. A mop head assembly comprising:

a base plate member having a generally flat bottom portion adapted to receive a flexible cleaning member;

an electric motor mounted on the base plate member at a laterally centered position thereon and having a rotatable shaft with an asymmetric weight mounted thereon, said shaft projecting downwardly from said electric motor and oriented substantially perpendicular to said base plate bottom portion, wherein rotation of said asymmetric weight on said shaft causes said base plate to vibrate primarily in a plane parallel to said flat bottom portion;

battery bays laterally symmetrically located on said base plate and operably electrically connected to said electric motor whereby batteries mounted in said battery bays provide driving energy to said electric motor; and a switch assembly operably electrically switchably connected between said battery bays and said electric motor, wherein said switch assembly comprises a plunger switch and a reciprocatable, upwardly biased cap member and wherein the switch assembly is foot actuatable through depression of the cap member.

8. The mop head assembly of claim 7 comprising:

a cover member attached to a top portion of said base plate member and having a shroud portion adapted to shroud said electric motor and said asymmetric weight and having open portions located above said battery bays and said plunger switch;

battery cover plates adapted to cover said open portions located above said battery bays; and wherein said cap member is reciprocally displaceably mounted in said open portion located above said plunger switch.

9. The mop head assembly of claim 8 further comprising:

a mop handle attachment portion located at a laterally and longitudinally centered point on said base plate member; and an indented, continuous moat region being formed around said mop handle attachment portion, said moat region containing said electric motor, said battery bays, said plunger switch and conductors electrically connecting said electric motor, said battery bays and said plunger switch.

* * * * *